US010730596B2

(12) United States Patent
Liu

(10) Patent No.: US 10,730,596 B2
(45) Date of Patent: Aug. 4, 2020

(54) SUBMARINE SUPPORT SHIP

(71) Applicant: Guang Liu, Tianjin (CN)

(72) Inventor: Guang Liu, Tianjin (CN)

( * ) Notice: Subject to any disclaimer, the term of this patent is extended or adjusted under 35 U.S.C. 154(b) by 0 days.

(21) Appl. No.: 16/277,135

(22) Filed: Feb. 15, 2019

(65) Prior Publication Data

US 2020/0031444 A1 Jan. 30, 2020

(30) Foreign Application Priority Data

Jul. 26, 2018 (CN) ..... 2018 1 0832408

(51) Int. Cl.

| | |
|---|---|
| ***B63C 11/50*** | (2006.01) |
| ***B63C 11/00*** | (2006.01) |
| ***B63B 3/13*** | (2006.01) |
| *B63B 11/00* | (2006.01) |
| *B63B 35/00* | (2020.01) |

(52) U.S. Cl.

CPC ..... *B63C 11/50* (2013.01); *B63B 3/13* (2013.01); *B63B 11/00* (2013.01); *B63B 2035/005* (2013.01); *B63B 2211/04* (2013.01)

(58) Field of Classification Search

CPC ..... B63G 8/00; B63B 27/00; B63B 27/08; B63B 27/16; B63B 35/00; B63B 35/02; B63B 35/44; B63B 3/00; B63B 3/13; B63C 1/00; B63C 1/12; B63C 7/00; B63C 7/02; B63C 11/00; B63C 11/50

USPC ..... 114/258, 259, 313, 322

See application file for complete search history.

(56) References Cited

U.S. PATENT DOCUMENTS

| | | | | |
|---|---|---|---|---|
| 4,312,287 A * | 1/1982 | Kuo | ..... | B63C 11/34 114/259 |
| 6,840,188 B1 * | 1/2005 | Witbeck | ..... | B63B 27/36 114/259 |
| 8,186,295 B2 * | 5/2012 | Fournier | ..... | B63G 8/42 114/332 |

(Continued)

*Primary Examiner* — Lars A Olson

(74) *Attorney, Agent, or Firm* — Garvey, Smith & Nehrbass, Patent Attorneys, L.L.C.; Vanessa M. D'Souza; Seth M. Nehrbass

(57) ABSTRACT

A submarine support ship is preferably a triple-hulled vessel; the lower portion of the ship is a paired-hull catamaran which is capable of deep diving, clasping the submarine at deep sea, and floating upwards together with the clasped submarine. The upper portion of the ship is a buoyancy tank, which can supply air to and pull up the deep-diving lower portion, and can also conduct security of an ocean-going submarine. For the submarine support ship of the present invention, by utilizing a mature deep diving submersible technology, the lower portion of the submarine support ship is manufactured as a deep-diving submersible in a submarine contour form, which is quickly separated from the upper portion of the submarine support ship and dives to reach the submarine position in the deep sea, clasps the submarine and then floats upwards together with the submarine as a whole to the water-surface position, such that the egress hatch of the submarine is docked with a dedicated docking hatch of the submarine support ship, to implement rescue security of the submarine; which mainly solves the problem that the rescue water-depth of current deep-diving lifeboats is shallow, but it also solves the problems that the deep-diving lifeboat has many rescue links, slow speed, and can only save people, but not submarines.

18 Claims, 7 Drawing Sheets

(56) References Cited

U.S. PATENT DOCUMENTS 9,120,544 B2 * 9/2015 Licht ..... B63G 8/001

* cited by examiner

SUBMARINE SUPPORT SHIP

This application claims priority to Chinese patent application number 201810832408.3, filed Jul. 26, 2018, with a title of SUBMARINE SUPPORT SHIP. The above-mentioned patent application is incorporated herein by reference in its entirety.

TECHNICAL FIELD

The present invention relates to the field of ship manufacturing technology, and in particular to a submarine support ship.

BACKGROUND

Submarines have been valued by countries all over the world for their unique concealment and strong combat effectiveness. Due to the significant role of submarines, submarine technology advances by leaps and bounds.

Currently, with respect to submarine technology development in the world: the US Ohio-class nuclear submarine has a length of 170.7 meters, a width of 12.1 meters, a displacement of 18,750 tons, a maximum dive depth of 400 meters, and a ship speed of 20 knots; the US most advanced Virginia-class nuclear submarine has a length of 115 meters, a width of 10 meters, a displacement of 8,000 tons, a maximum dive depth of 500 meters, and a ship speed of 25 knots; the Russian Borey-class nuclear submarine has a length of 170 meters, a width of 13 meters, a maximum dive depth of 450 meters, a displacement of 17,000 tons, and a ship speed of 26 knots; the UK vanguard-class nuclear submarine has a length of 149.9 meters, a width of 12.8 meters, a maximum dive depth of 350 meters, a displacement of 16,000 tons, and a ship speed of 25 knots; the French Triomphant-class nuclear submarine has a length of 138 meters, a width of 12.5 meters, a displacement of 14,000 tons, a maximum dive depth of 500 meters, and a ship speed of 25 knots; China's Type 095 nuclear submarine has a length of 150 meters, a width of 20 meters, a displacement of 15,000 tons, a maximum dive depth of 600 meters, and a ship speed of 35 knots; India's Chakra nuclear submarine has a length of 115 meters, a width of 14 meters, a displacement of 9500 tons, a maximum dive depth of 650 meters, and a ship speed of 32 knots; Germany's Type 214 submarine has a length of 65 meters, a width of 6.3 meters, a displacement of 1,700 tons, a maximum dive depth of 400 meters, and a ship speed of 20 knots; and Japan's Soryu-class nuclear submarine has a length of 84 meters, a width of 9.1 meters, a displacement of 4,200 tons, a maximum dive depth of 500 meters, and a ship speed of 20 knots.

Deep diving submersibles are diving devices that can work underwater in the deep sea. They generally have a displacement of about 20-80 tons (though in individual cases reaching about 300-400 tons), a diving depth generally of about 2,000-5,000 meters (though in individual cases reaching about 11,000 meters), and are mainly used for marine survey, exploration, detection, mine-laying, rescue of submariners of a disabled submarine. Japan's "Deep Sea-6500" submersible can seat 3 passengers and operates to a water depth of 6,500 meters; China's "Jiaolong" manned submersible dives to 7,062 meters; Russia's Mir 2 manned submersible is of the class of 6,000 meters; the director Cameron of "Avatar" drove the "Deep Sea Challenger" manned submersible to dive into the deep water of 10,898 meters in the Mariana Trench; and the US "Trieste" deep submersible has a maximum manned diving depth of 10,916 meters, which is only 118 meters less than the deepest point of the ocean, the Mariana Trench, which is 11,034 meters deep.

Submarine sea damage accidents in peacetime often occur. These accidents can be caused by collision, stranding, sea waterline damages, striking a rock, fire disasters, explosions, operational errors, sea-conditions, rudder sticking, technical and device failures, and the like. During 90 years between 1900 and 1989, worldwide non-combat sea damage accidents of submarines totaled 631 cases, and caused 287 submarines to be wrecked and sunk. Among these accidents, 75% of the wrecked submarines were at a depth where a submariner "could escape", and 85% of the wrecked and sunk submarines were settled on the seabed at a certain depth or suspended at a certain depth where the submarines could not be floated by themselves. In the latter case, the submariner could use the self-rescue device provided inside the submarine to self-rescue and escape or could be rescued by means of a rescue device.

Currently, the facilities used for escape (self-rescue) of a submariner from a wrecked submarine include the following: a collective floating rescue capsule, a fast-rising danger escape device, and an underwater danger escape device; and the equipment for underwater life-saving (rescue includes: a deep diving lifeboat, a rescue bell system and a submarine rescue ship.

The submarine rescue ship's task includes carrying submarine rescue personnel, the diving rescue bell system, a deep-diving lifeboat system and support equipment, other submarine rescue instruments, etc., to the sea area where the submarine was wrecked to carry out the rescue.

The deep-diving lifeboat refers to a miniature dinghy that can dive into the deep sea to rescue a submariner from a wrecked submarine and has a basic structure similar to that of a submarine. The lifeboat has a displacement of over ten tons to dozens of tons, and a ship speed of several knots. The lifeboat has a small endurance, and thus is generally carried by a deep-diving life-saving mother ship or a salvage lifting vessel to the sea area where the submarine is wrecked. The under-boat cylindrical connection device is docked with a rescue platform of the wrecked submarine to form a passage, so as to rescue the personnel of the wrecked submarine into the deep-diving lifeboat and then transfer them to the mother ship. Deep-diving lifeboats generally have a diving depth of 600-1,000 meters, though the deep-diving lifeboat with the maximum rescue depth is the US DSRV, with a maximum diving depth of 1,524 meters.

Japan's "Chiyoda", which was commissioned in 2018, is a 5,600-ton-class submarine rescue ship with a length of 128 meters, a maximum deck width of 20 meters, and a maximum ship speed of 20 knots. It uses a deep-sea diving device carried on it to rescue the submariner.

The above-mentioned self-rescue and rescue facilities are all utilized to rescue the submariner of the wrecked submarine.

However, submarine rescue technology develops slowly. The self-rescue and rescue technology for submarine rescue still has many technical problems that are difficult to solve. Submarine rescue technology does not develop at the same pace with submarine technology and thus there is a great difference between submarine technology and submarine rescue technology.

The prior art launches a deep-diving rescue bell, a deep-diving lifeboat, and the like, towards the submarine, docking them with the rescue platform of the submarine to form a rescue passage, so as to rescue the submarine personnel into the deep-diving lifeboat and then transfer the personnel to the mother ship, which requires that the deep-diving rescue device be docked with the submarine in the deep sea. Since the water pressure in the deep sea is very high, sometimes the precise internal conditions of the submarine are unknown, and the technical difficulty is great. The maximum rescue depth of the current deep-diving rescue methods is about 1,524 meters which can only be achieved by the United States. However, this rescue method can only rescue people (not submarines) and has a low speed; these are significant limitations which serve as an example of how submarine rescue technology is at a significantly different level from the level of deep diving submersibles by which humans conquer the deep sea.

SUMMARY

The present invention includes a submarine support ship. By utilizing mature deep diving submersible technology, the lower portion of the submarine support ship is manufactured as a deep-diving submersible in a submarine contour form, which is quickly separated from the upper portion of the submarine support ship and dives to reach the submarine position in the deep sea, clasps the submarine and then floats upwards together with the submarine as a whole to the water-surface position, such that the egress hatch of the submarine is docked with a dedicated docking hatch of the submarine support ship, to implement rescue security of the submarine. The present invention solves the main problem that the rescue water-depth of current deep-diving lifeboats is shallow and also solves the following: that deep-diving lifeboats have many rescue links, a slow speed, and can save people, but cannot save submarines.

The present invention provides a submarine support ship, including a buoyancy tank and a paired-hull catamaran which are docked with each other from top to bottom, where the paired-hull catamaran includes two side hulls, and each thereof has the upper and lower portions coupled by several pairs of steel hinges which are arranged symmetrically and spaced apart from each other, where the lower steel hinge can be disengaged and separate the connection between the two side hulls, each of the two side hulls is provided with a control cabin, a power system and an activity space, where the power system includes a propeller; the two side hulls of the paired-hull catamaran are each semi-arc-shaped, and the paired-hull catamaran has a section presented as water-drop-shaped after the two side hulls are coupled together by the upper and lower steel hinges, the curved inner wall of the paired-hull catamaran matches the contour of the submarine, and the curved inner wall is used for receiving the submarine; the inner wall of the paired-hull catamaran is provided with an inflatable bladder thereon; each steel hinge is provided with steel-hinge guard arms on both sides thereof, and the distance between respective steel-hinge guard arms meets the space setting/size of the submarine bridge;

the buoyancy tank is saddle-shaped, and the two sides of the buoyancy tank are engaged with the curved top portion of the paired-hull catamaran, the buoyancy tank is provided with a control cabin, an autonomous auxiliary power device and a replenishment cabin therein, and the autonomous auxiliary power device includes a propeller arranged on the buoyancy tank; the buoyancy tank is provided with hatch doors in front of and behind both sides thereof, the buoyancy tank is provided with a concealed hatch to be docked with the submarine therein, the positions on the four corners of the buoyancy tank where the buoyancy tank is engaged with the paired-hull catamaran are provided with chains which are coupled with the paired-hull catamaran, and the buoyancy tank is also provided thereon with a double-breather-pipe ring connected to the two side hulls.

Preferably, the paired-hull catamaran is also provided therein with a storage battery. Preferably, the propeller includes concave and rotatable flanking propellers which are disposed at the broadside and a main propeller equipped with propeller blades which is disposed at the stern.

Preferably, the lower portion of each of the two side hulls of the paired-hull catamaran is provided with a counterweight tank, solid steel spheres or other similar heavy, flowable material, for example beads or ferro-nickel; when solid steel spheres are used, they can have a diameter of 4-20 mm, are placed in the counterweight tank for counterweight, and a steel sphere discarding valve is disposed at the bottom end of the counterweight tank.

Preferably, the upper portion of each of the two side hulls of the paired-hull catamaran is provided with a buoyancy adjustment tank, many multigrade hollow steel balls with different sizes are placed in the buoyancy adjustment tank, and the buoyancy adjustment tank is filled full of the multigrade hollow steel balls.

Preferably, the middle portion of the paired-hull catamaran is provided with a ballast tank, and the water filling amount of the ballast tank is adjustable.

Preferably, the double-breather-pipe ring includes two concentric breather pipes, where an exhaust pipe is located at the outer ring and an intake pipe is located at the inner ring; one end of the double-breather-pipe ring is wound on a breather-pipe reel arranged on the buoyancy tank, and the other end of the double-breather-pipe ring is connected to the paired-hull catamaran through a breather-pipe flange; and the double-breather-pipe ring is wound off or up according to the diving depth of the paired-hull catamaran.

Preferably, a high-pressure gas intake and exhaust device is arranged at the intake and exhaust port position of the double-breather-pipe ring on the buoyancy tank; and a linear communication circuit is disposed in the double-breather-pipe ring, and an underwater transmitting and receiving system for communication is installed at the flange connecting the breather pipe and the paired-hull catamaran.

Preferably, one end of the coupling chain between the buoyancy tank and the paired-hull catamaran is coupled to the four corners at front and rear sides of the paired-hull catamaran, and the other end thereof is wound on a chain drum inside the buoyancy tank; and the chain is wound off or up according to the diving depth of the paired-hull catamaran.

Preferably, the inflatable bladder can be filled with both water and gas.

The present invention also provides a submarine and submarine support ship apparatus, wherein the submarine support ship apparatus is set forth above.

The present invention achieves the following:

1. The submarine support ship of the present invention salvages the submarine in a chain floating upward manner: by using the technical capacity of the deep-diving submersible of deep diving to the world's deepest seabed at 10,916 meters, the deep-diving submersible having two hinges is manufactured in a submarine contour form, namely, a paired-hull catamaran, dives into the deep sea, clasps the submarine, and then floats upwards through a connection chain by means of a surface buoyancy tank, so as to achieve the integral salvage of the deep sea submarine.

2. The five parts of the paired-hull catamaran that can dive: a hull body, a ballast tank, a counterweight tank, a buoyancy adjustment tank, and a manned space, are organically configured and the ballast tank achieves weight adjustment within a certain small range; the counterweight tank adopts metallic steel spheres which have a small volume and large specific gravity, and can slide freely, and thus can weigh down very large buoyancy by means of a very small volume; the buoyancy adjustment tank adopts graded hollow steel balls to enable a weight as small as possible, to occupy a volume as large as possible, and to enable a remained space as small as possible, the hollow steel balls can withstand the large deep-sea water pressure, and facilitate the periphery wall of the buoyancy adjustment tank to be evenly stressed, so that not much sea water can enter the buoyancy adjustment tank even when the buoyancy adjustment tank is permeable to water in the deep sea, so as to keep the buoyancy to the hilt, and to occupy a large space without gaps by using a very small weight; by using the opposite functions of the counterweight tank and the buoyancy adjustment tank, it can be achieved that there is a sufficient weight to sink if such is desired, and there is a sufficient storage buoyancy to float upwards if same is desired, and through the reasonable organic configuration of the weights and volumes of the aforementioned five parts, safe diving and floating upwards can be achieved in various different situations.

3. Salvaging a submarine in a storage buoyancy manner: the deep-diving submersible having two hinges is manufactured in a submarine contour form, namely, a paired-hull catamaran, dives into the deep sea, clasps the submarine, and then floats upwards using the storage buoyancy when the buoyancy of the ballast tank is not enough, where a large storage buoyancy is obtained by opening a steel sphere discarding valve of the counterweight tank to discard the counterweight of the steel spheres, and thus the submersible floats upwards together with the clasped submarine, so as to achieve the integral salvage of the deep sea submarine.

4. The submarine support ship implements concealed security of the submarine: a battery power supply mode of the paired-hull catamaran is started, and the paired-hull catamaran is disconnected with a fixing device of the buoyancy-tank, disconnected with a breather-pipe flange and a chain flange, dives after the hatch is closed, and is docked with the submarine by opening the lower steel hinge; the inflatable bladder is filled with water to fix the submarine to the paired-hull catamaran, and the paired-hull catamaran floats upwards together with the submarine clasped by it as a whole; after the paired-hull catamaran is docked with and fixed to the buoyancy tank, the concealed security hatch of the buoyancy tank providing access to the submarine is opened and the hatch cover of the submarine is opened to conduct maintenance, overhaul, and replenishment of the submarine; and then the submarine is released into the sea; so as to achieve the concealed security of the submarine by the submarine support ship.

BRIEF DESCRIPTION OF THE DRAWINGS

To describe the technical features of the present invention or in the prior art more clearly, the following briefly describes the accompanying drawings depicting certain embodiments. The accompanying drawings in the following description show merely some embodiments of the present invention, and a person of ordinary skill in the art may still derive other drawings from these accompanying drawings without creative efforts.

DETAILED DESCRIPTION

Figure 1:
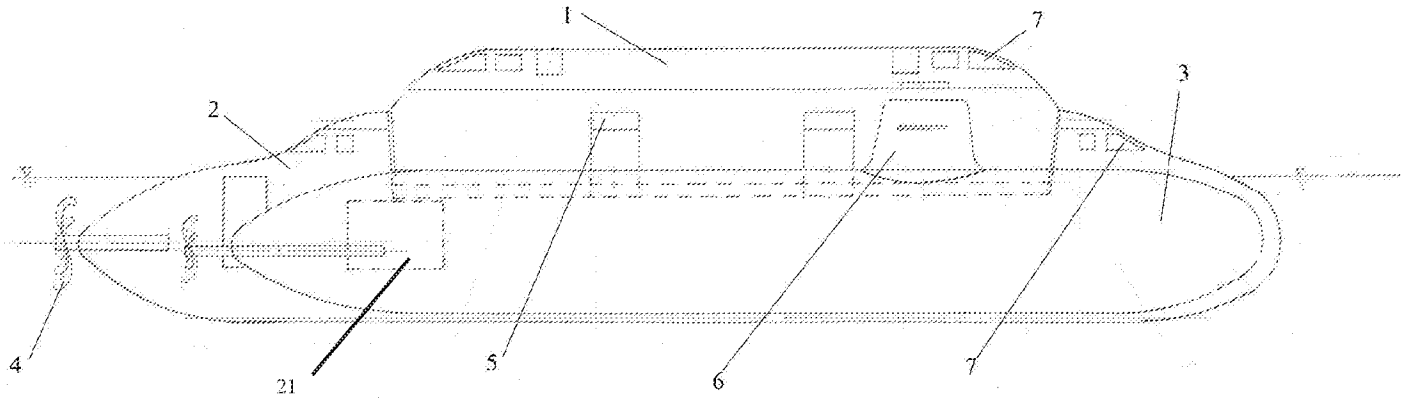
FIG. 1 is a cross-sectional view of a submarine support ship with clasped submarine.

The following describes technical features of preferred embodiments of the present invention with reference to the accompanying drawings. The described embodiments are merely a part rather than all of the embodiments of the present invention. All other embodiments obtained by a person of ordinary skill in the art based on the embodiments of the present invention without creative efforts shall fall within the protection scope of the present invention.

The objective of the present invention is to provide a submarine support ship. By utilizing a mature deep diving submersible technology, the lower portion of the submarine support ship is manufactured as a deep-diving submersible in a submarine contour form, which is quickly separated from the upper portion of the submarine support ship and dives to reach the submarine position in the deep sea, clasps the submarine and then floats upwards together with the submarine as a whole to the water-surface position, such that the egress hatch of the submarine is docked with a dedicated docking hatch of the submarine support ship, to implement rescue security of the submarine. The present invention mainly solves the problem that the rescue water-depth of the current deep-diving lifeboat is shallow and also solves the following: that the deep-diving lifeboat has many rescue links, a slow speed, and can save people, but cannot save submarines.

The submarine support ship provided by the present invention includes a buoyancy tank and a paired-hull catamaran which are docked with each other from top to bottom. The paired-hull catamaran includes two side hulls, each has two upper and lower portions linked by several pairs of steel hinges which are arranged symmetrically and spaced apart from each other, where the lower steel hinge can be separated and connected, each of the two side hulls is provided with a control cabin, a power system and an activity space, where the power system includes a propeller; the two side hulls of the paired-hull catamaran are each semi-arc-shaped, and the paired-hull catamaran has a section presented as water-drop-shaped after the two side hulls are linked together by the upper and lower steel hinges, the curved inner wall of the paired-hull catamaran matches the contour of the submarine, and the curved inner wall is used for receiving the submarine; the inner wall of the paired-hull catamaran is provided with an inflatable bladder thereon; each steel hinge is provided with steel-hinge guard arms on both sides thereof, and the distance between respective steel-hinge guard arms meets the space setting of the submarine bridge.

The buoyancy tank is saddle-shaped, and the two sides of the buoyancy tank are engaged with the curved top portion of the paired-hull catamaran, the buoyancy tank is provided with a control cabin, an autonomous auxiliary power device and a replenishment cabin therein, and the autonomous auxiliary power device includes a propeller arranged on the buoyancy tank; the buoyancy tank is provided with hatch doors in front of and behind both sides thereof, the buoyancy tank is therein provided with a concealed hatch to be docked with the submarine, the positions on the four corners of the buoyancy tank where the buoyancy tank is engaged with the paired-hull catamaran are provided with chains which are coupled with the paired-hull catamaran, and the buoyancy tank is also provided thereon with a double-breather-pipe ring connected to the two side hulls.

In order to make the above objectives, features and advantages of the present invention more apparent, the present invention will be further described in detail with reference to the accompanying drawings and specific embodiments.

Figure 2:
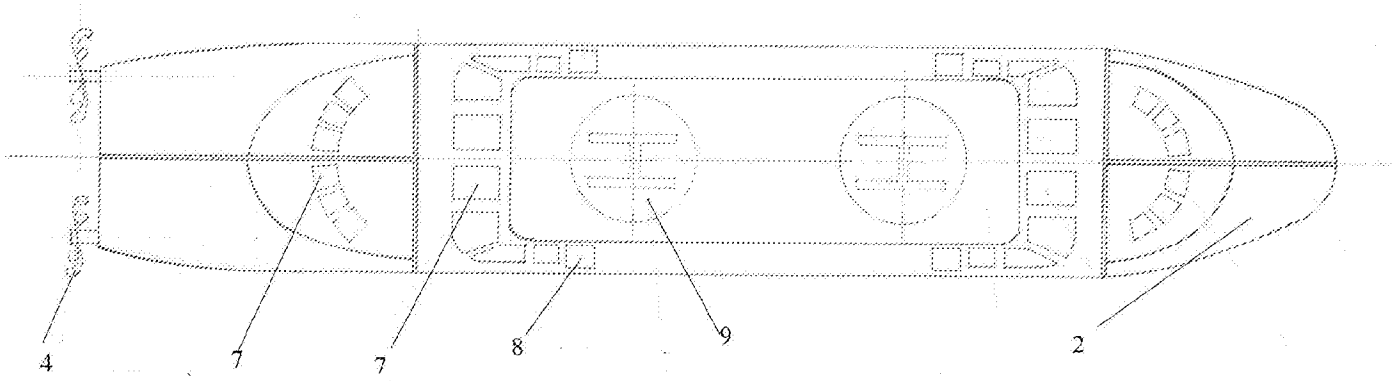
FIG. 2 is a top view of the submarine support ship.
Figure 3:
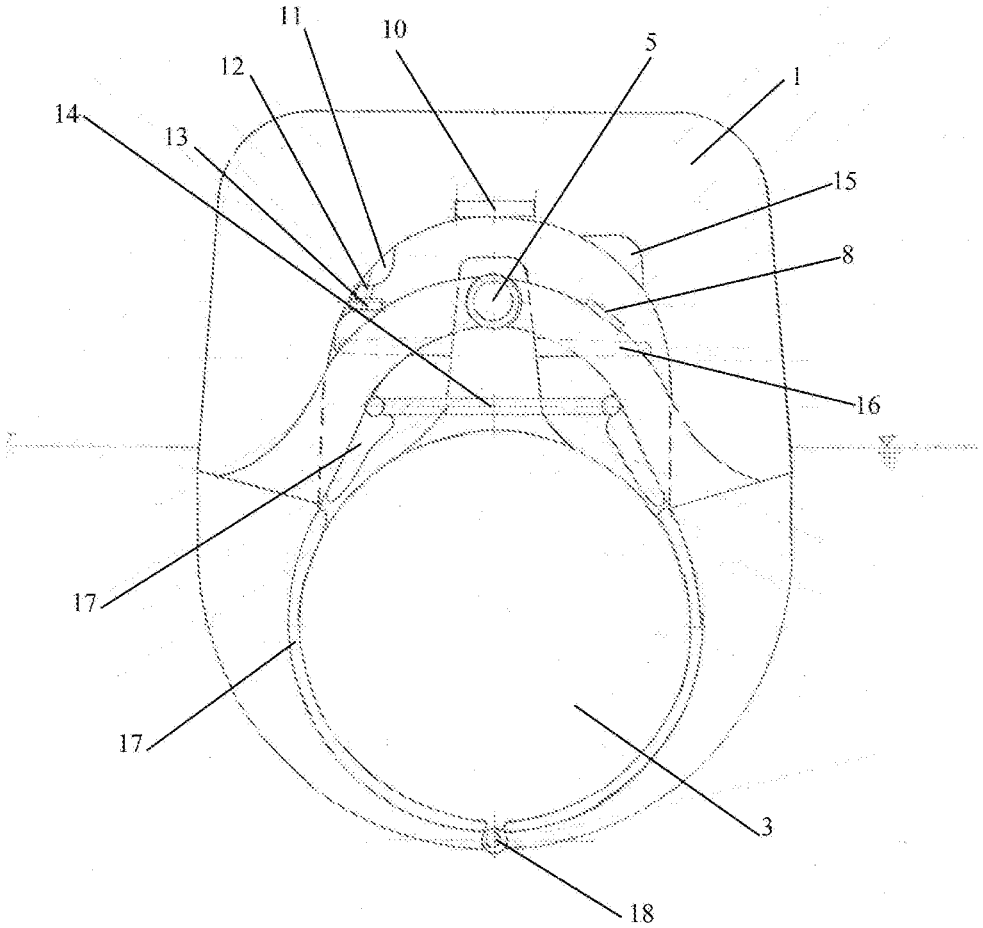
FIG. 3 is a cross-sectional view of the upper buoyancy tank and paired-hull catamaran with a clasped submarine.
Figure 4:
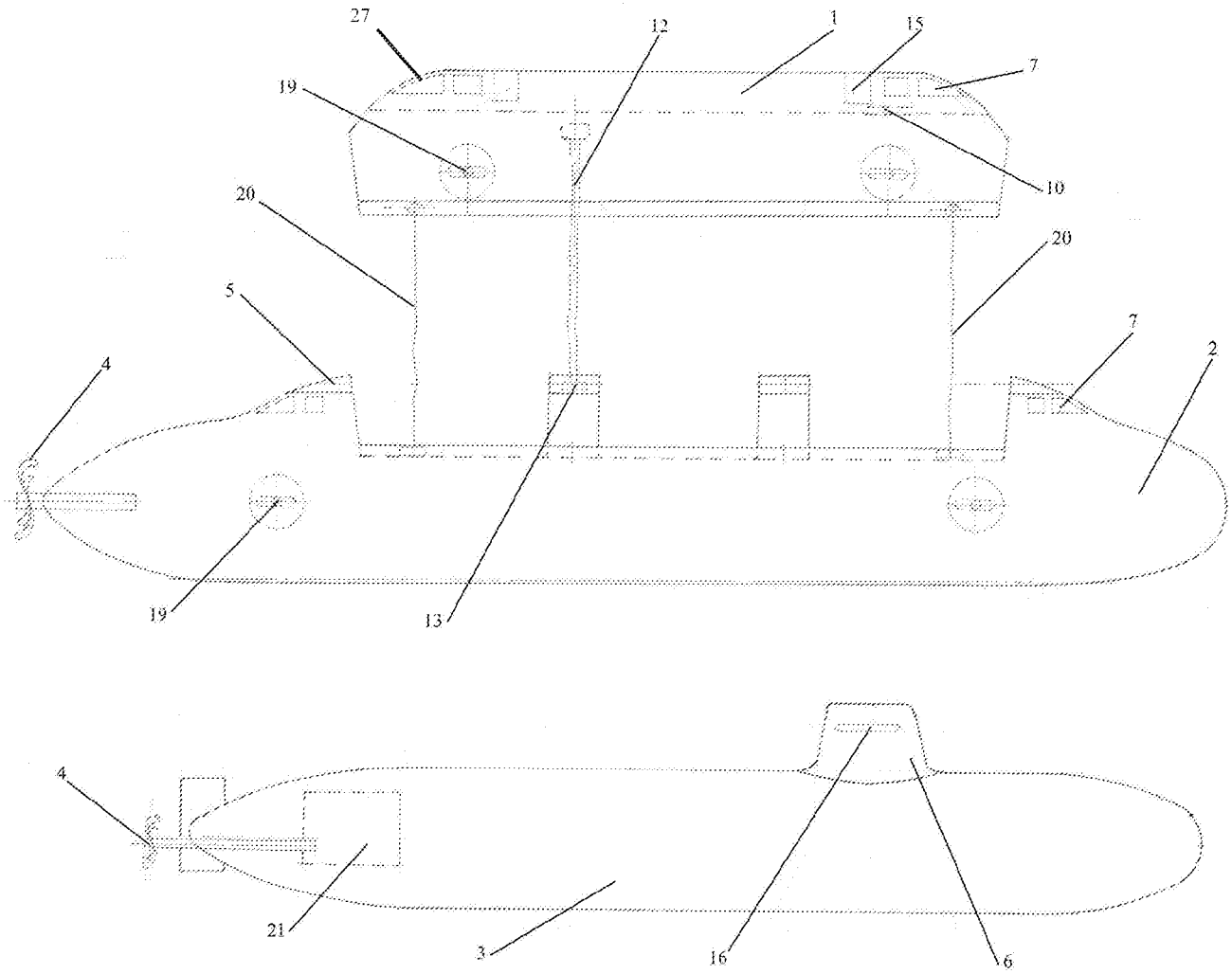
FIG. 4 is a schematic view showing the relative positions of the upper buoyancy tank and the lower submarine when the paired-hull catamaran dives to rescue the submarine.
Figure 5:
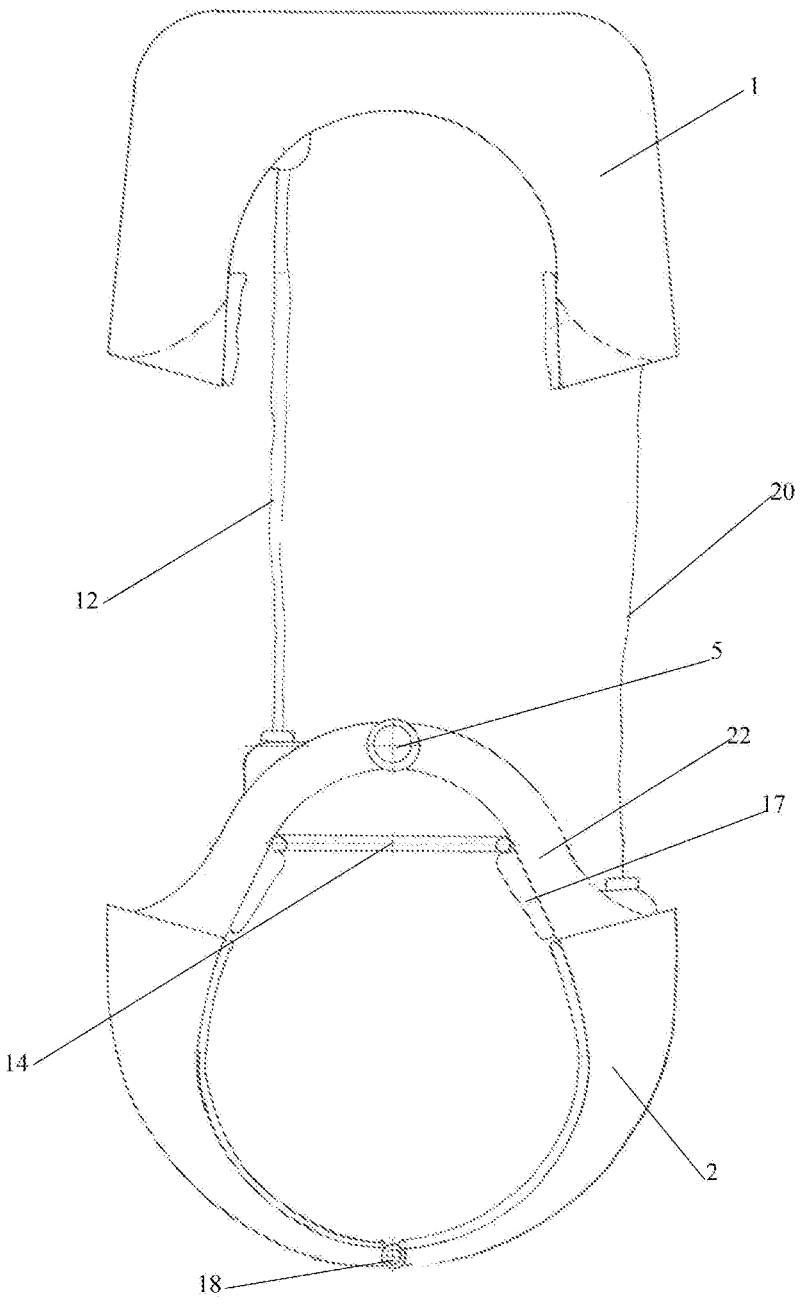
FIG. 5 is a schematic view of the paired-hull catamaran when it dives away from the buoyancy tank.
Figure 6:
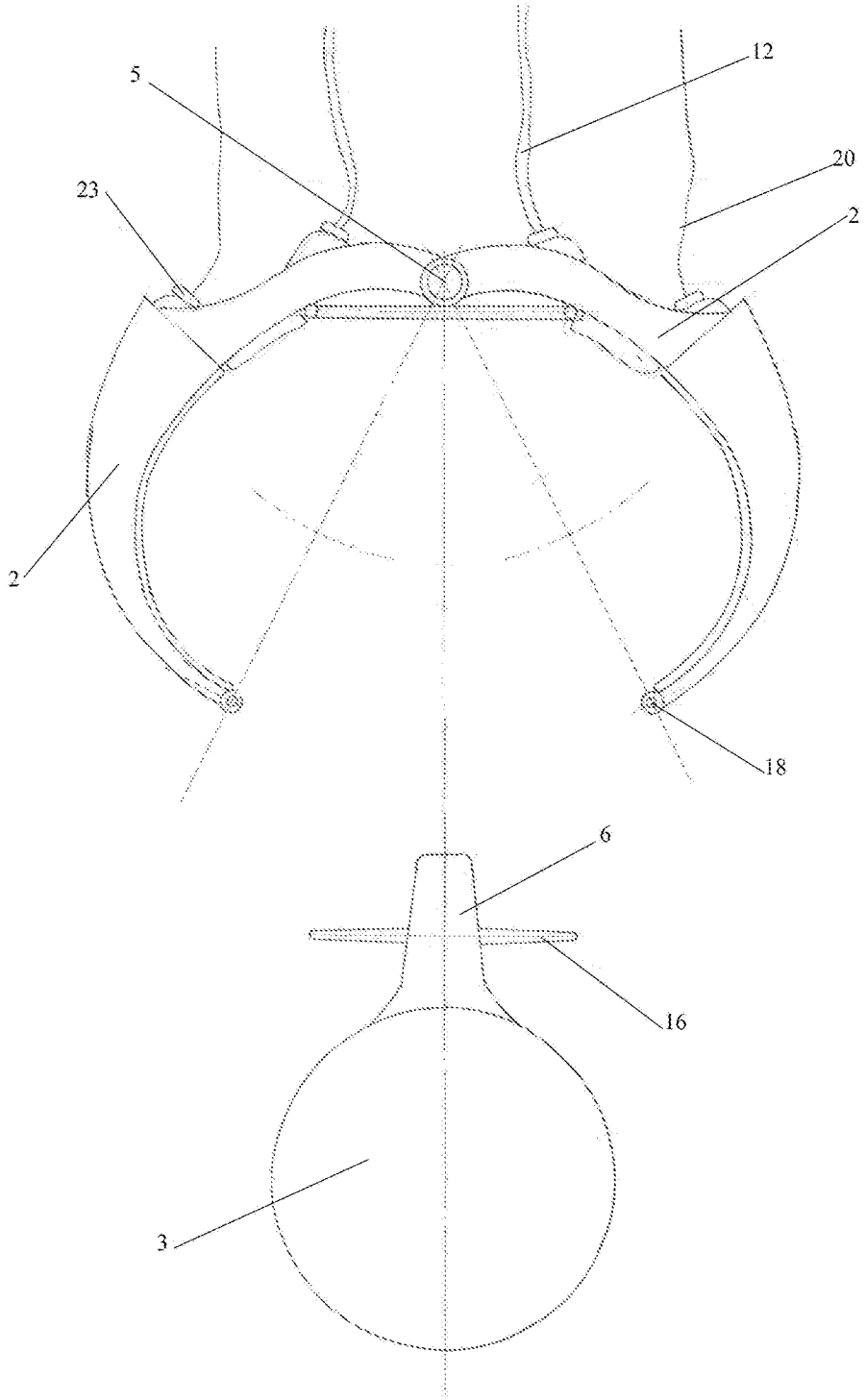
FIG. 6 is a schematic view of the paired-hull catamaran when the symmetric hull is opened to prepare for submarine rescue.
Figure 7:
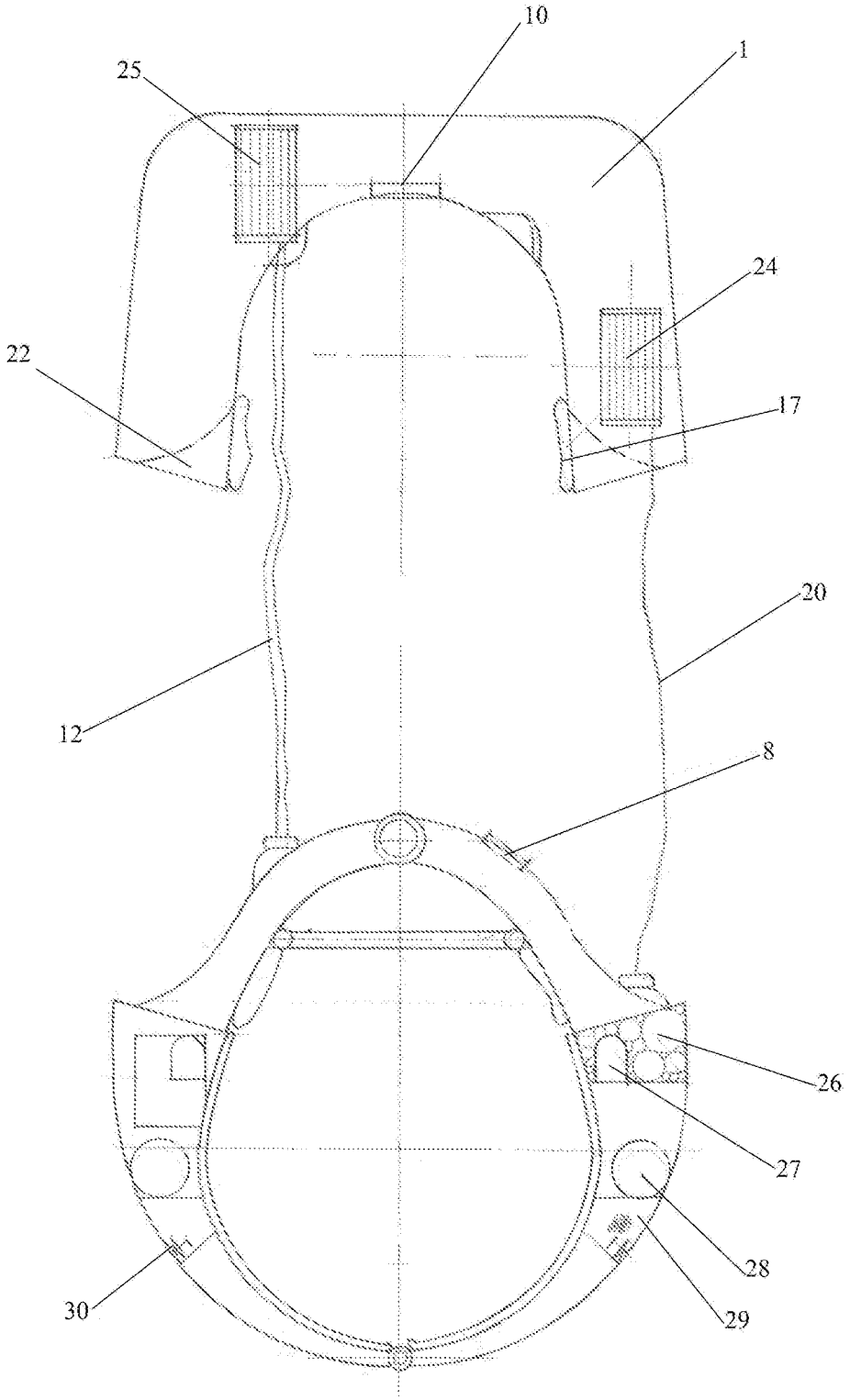
FIG. 7 is a schematic view when the buoyancy tank is separated from the paired-hull catamaran.

As shown in FIGS. 1-7, the present invention provides a triple-hulled submarine support ship.

The lower portion of the ship is a paired-hull catamaran 2 which is capable of deep diving, clasping the submarine 3 at the deep sea by its own shape, and floating upwards together with the clasped submarine. The upper portion of the ship is a buoyancy tank 1, which can supply air to and pull up the deep-diving lower portion, and can also conduct security of an ocean-going submarine. The triple-hulled submarine support ship can carry out deep-sea rescue of the failed submarine 3, conduct deep-sea integral salvage, perform ocean-going launch and withdrawal of the submarine 3, perform supply guarantee, maintenance, medical rescue and personnel rotation of the ocean-going submarine, etc.

The paired-hull catamaran 2 has upper and lower portions respectively connected by an upper steel hinge 5 and a lower steel hinge 18, where the lower steel hinge 18 can be separated. The two hulls each have a control cabin 7, an engine room 21, a screw propeller, a steering rudder, a ballast tank 28, a counterweight tank 29, a buoyancy adjustment tank 26, a robot, etc. The buoyancy tank 1 is also provided with a parking apron 9, a manned cabin and a corridor 27 on the top surface thereof. In front of and behind two sides of the paired-hull catamaran 2 arranged are four concave and rotatable flanking propellers 19, and a main propeller 4 equipped with propeller blades is arranged at the rear end of the hull; the two hulls of the paired-hull catamaran 2 are each semi-arc-shaped, and after the two hulls are linked by the upper and lower steel hinges, the paired-hull catamaran has water-drop-shaped front and rear portions, the contour of the front and rear portions being similar to that of the submarine 3. The middle portion of the paired-hull catamaran is generally U-shaped and semicircular, and is provided with a pair of upper steel-hinge guard arms 22 spaced apart from each other by a distance. The spacing distance between the steel-hinge guard arms 22 meets the space of the submarine bridge 6. The two symmetric hulls are combined into a deep-diving submersible capable of diving into the deep sea, and the lower steel hinge 18 is opened, such that the submersible is presented as semicircular-shaped with opening downward, and the circular inner wall is provided with at least one arc-shaped inflatable bladder 17 which can be inflated or filled with water; and the power of the paired-hull catamaran 2 is the main screw propeller located at the stern, and when a storage battery is used, the front and rear concave and rotatable flanking propellers can be activated.

The upper buoyancy tank 1 is docked with the lower paired-hull catamaran 2, and the buoyancy tank 1 is designed as saddle shaped, with the two sides thereof engaged with the middle U-shaped top portion of the paired-hull catamaran 2. The paired-hull catamaran 2 holds the saddle-shaped buoyancy tank 1 thereon. The three hulls form a submarine support ship. The interior of the ship is hollow and of the contour of the submarine body. The paired-hull catamaran 2 provides a dual-propeller symmetrical dual power for the submarine support ship. The buoyancy tank 1 is provided with an autonomous auxiliary power device, and in front of and behind both sides of the buoyancy tank 1 arranged are four concave and rotatable flanking propellers 19. When the submarine support ship operates normally, the main power of the paired-hull catamaran 2 can be uniformly used. When the paired-hull catamaran 2 moves away from the buoyancy tank 1, the buoyancy tank 1 activates the autonomous power system to power the buoyancy tank 1 to move autonomously when the paired-hull catamaran 2 moves away from the buoyancy tank 1. The buoyancy tank 1 is configured to conduct goods and materials supply, equipment transportation, medical rescue, equipment maintenance and the like functions. The buoyancy tank 1 is provided with hatch doors 15 in front of and behind both sides thereof, for conducting goods and materials supply and non-concealed replenishment of the submarine 3, and also for providing the personnel with a passage to go into and out of the buoyancy tank 1. The buoyancy tank 1 is therein provided with a hatch 10 to be docked with the paired-hull catamaran 2, for the personnel and goods and materials to go into and out of the paired-hull catamaran 2. The buoyancy tank 1 is therein provided with a concealed hatch 8 to be docked with the submarine 3, for supplying goods and materials to the submarine 3 by the buoyancy tank 1, and also for providing the buoyancy tank 1 with a passage to go into and out of the submarine 3. The positions on the four corners of the buoyancy tank 1 where the buoyancy tank is engaged with the paired-hull catamaran 2 are provided with positioning and coupling chains 20, for positioning and lifting the paired-hull catamaran 2 when it dives and floats upwards. The buoyancy tank 1 is therein provided with a double-breather-pipe ring 12 for security of air intake and exhaust when the paired-hull catamaran 2 dives.

Power of the paired-hull catamaran: paired-hull catamaran 2 is provided with conventional power, which is also the basic power of the submarine support ship and the conventional power of the dual propellers. Paired-hull catamaran 2 is provided with a storage battery power, such that when the breather pipe cannot be used normally as the paired-hull catamaran dives too deep, or as the paired-hull catamaran encounters a strong ocean current, it should turn off the engine and activate the battery power supply system, disconnect the breather pipe and the coupling chains 20, and then continue the dive operation.

Power of the buoyancy tank: when the buoyancy tank 1 and the paired-hull catamaran 2 form the submarine support ship, the power of the paired-hull catamaran 2 can be uniformly used. The buoyancy tank 1 itself is also provided with auxiliary conventional power. When moving away from the buoyancy tank 1, the paired-hull catamaran 2 uses its own configured power to operate independently by the concave and rotatable flanking propellers 19.

The buoyancy setting of the paired-hull catamaran: in order to enable the paired-hull catamaran 2 to dive deeper into the sea area, and in order to enable the paired-hull catamaran to float upwards urgently and self-rescue when it encounters an emergency situation and loses power during diving operation, a steel sphere counterweight having a small volume and a large weight is arranged in the counterweight tank 29, such that in an emergency situation, the steel sphere discarding valve 30 of the counterweight tank 29 can be automatically or manually opened to discard the steel spheres into the sea, and thus the dived paired-hull catamaran 2 can float upwards automatically and achieve self-rescue. The counterweight tank 29 is arranged on the lower portion of the paired-hull catamaran 2 to keep the center of gravity of the paired-hull catamaran 2 below halfway and to keep the verticality and stability of the paired-hull catamaran 2. The steel sphere discarding valve 30 set at the bottom of each counterweight tank 29 can completely discard the steel spheres. Hollow steel balls having large volumes, small weights and high compression strength (for example, 110000 MPa (megapascal)) are filled into the buoyancy adjustment tank 26, the hollow steel balls can withstand the deep-sea water pressure and have different sizes (for example, large hollow steel balls having a diameter of 100-500 cm and a wall thickness of 20-50 mm, small hollow steel balls having a diameter of 10-100 cm and a wall thickness of 6-20 mm, and smaller hollow steel balls having a diameter of 2-10 mm and a wall thickness of 4-6 mm) and a grading configuration (for example, first filled with large hollow steel ball, then small hollow steel ball, and finally smaller hollow steel ball), small hollow steel balls fill the gaps between large hollow steel balls, and smaller hollow steel balls fill the gaps between the small hollow steel balls, such that not much sea water can enter the buoyancy adjustment tank 26 even when the buoyancy adjustment tank is permeable to water, so as to ensure the buoyancy reserve of the buoyancy adjustment tank 26, and additionally reduce the volume of the gaps, increase the supporting points on the side walls of the buoyancy adjustment tank 26, and enhance the capability of the buoyancy adjustment tank 26 of withstanding the deep-sea water pressure. The buoyancy adjustment tank 26 is arranged on the upper portion of the paired-hull catamaran 2, and thus the center of gravity of the paired-hull catamaran 2 is below halfway to keep the verticality and stability of the paired-hull catamaran 2. The ballast tank 28 is arranged on the middle portion of the paired-hull catamaran 2, and thus to enable the paired-hull catamaran 2 to complete the task of deep-sea salvage of a modern large submarine, the paired-hull catamaran 2 itself should also dive deep to the position of the submarine 3 and float upwards to the water surface together with the submarine 3 clasped by it, and the paired-hull catamaran 2 should also have a certain volume. The following gives the preferred volume and weight proportions of respective main parts of the paired-hull catamaran 2 capable of diving, wherein even when all cabins of the dived paired-hull catamaran 2 are filled with water, the hull can float upwards through weight loss only by opening the steel sphere discarding valve 30 of the counterweight tank 29 to make the slidable steel spheres, which have a much larger specific gravity than that of the sea water, freely fall off into the sea outside the tank. The weight and volume proportions of respective parts of the paired-hull catamaran 2 are preferably: the paired-hull catamaran 2 has a solid weight accounting for about 32%, and a volume accounting for about 10%; the ballast tank 28 has a weight accounting for about 0% and a volume accounting for about 12% when it is empty, and the ballast tank 28 has a weight accounting for about 12% and a volume still accounting for about 12% when it is full of water; the steel spheres, for example round steel spheres have a diameter of 4-20 mm, of the counterweight tank 29 have a weight accounting for about 50% and a volume accounting for about 14%; the hollow steel balls of the buoyancy adjustment tank 26 have a weight accounting for about 12% and a volume accounting for about 40%; the control cabin, the corridor 27 and all cabins together have a weight accounting for about 0% and a volume accounting for about 24%. When the steel spheres are discarded, and all cabins of the paired-hull catamaran 2 are full of water, the weight proportions of respective parts are: the paired-hull catamaran 2 has a solid weight accounting for about 32%; the ballast tank 28 still has a weight accounting for about 12%; the counterweight tank 29 has a weight accounting for about 14% when the steel spheres are discarded from it and it is filled with water; the buoyancy adjustment tank 26 still has a weight accounting for about 12%; the control cabin, the corridor 27 and all cabins together have a weight accounting for about 24% when they are full of water. The total weight accounts for about 94% of the total displacement. That is, the paired-hull catamaran 2 surfaces by itself.

Normal floating upwards: generally, when the ballast tank 28 is empty, the total weight of the paired-hull catamaran 2 accounts for about 94% of the total displacement. When the paired-hull catamaran 2 is to dive, water is filled into the ballast tank 28, and at most water having a weight accounting for about 12% of the total displacement of the paired-hull catamaran 2 can be filled into the ballast tank. At this time, the total weight of the paired-hull catamaran 2 accounts for 106% of the total displacement, and the ballast tank 28 can control the water weight to make the total weight account for between about 94%-106% of the total displacement, such that by adjusting the water filling amount of the ballast tank 28, the diving and floating upwards of the paired-hull catamaran 2 can be achieved. When the paired-hull catamaran 2 floats upwards together with the submarine clasped by it, it cannot use the buoyancy accounting for 6% of the displacement of the paired-hull catamaran 2 by itself to reach the buoyancy required for floating upwards together with the submarine 3 clasped by it, and it is necessary to float upwards by pulling up through the chain 20 by means of the buoyancy tank 1, so as to realize the purpose of floating upwards of the paired-hull catamaran 2 together with the submarine 3 clasped by it as a whole.

Floating upwards through storage buoyancy: when both the double-breather-pipe ring 12 and the chain 20 cannot be used as the paired-hull catamaran 2 dives deeper into the deep sea water area to conduct rescue of the submarine 3 or as the paired-hull catamaran encounters large ocean current, the engine of the paired-hull catamaran 2 is turned off and a battery power supply mode is started, and the double-breather-pipe ring 12 and the chain 20 are disconnected. When the paired-hull catamaran 2 floats upwards together with the submarine 3 clasped by it, by discharging the entire water body of the ballast tank 28, the buoyancy accounting for about 6% of the displacement of the paired-hull catamaran 2 is generated, which cannot reach the buoyancy required for floating upwards of paired-hull catamaran 2 together with the submarine 3 clasped by it as a whole. Therefore, additional buoyancy is required for the floating upwards of the submarine 3. The total buoyancy should be smaller than the total displacement when the submarine 3 dives, and when the submarine 3 stays in the deep sea, the maximum weight gain is the water filled in all spaces, which increases the water body weight of the space compared with that when the submarine 3 dives normally; at this time, if it is wanted to enable the floating upwards of the paired-hull catamaran 2 together with the submarine 3 clasped by it, a storage buoyancy mode should be started: the steel sphere discarding valve 30 of the counterweight tank 29 is opened to discard the steel spheres, and accordingly the counterweight tank 29 is filled with sea water, and the maximum buoyancy generated at this time is a maximum storage buoyancy accounting for about 36% of the total displacement of the paired-hull catamaran 2, which is obtained by removing the steel spheres which account for about 50% of the total weight and thus obtaining the water body weight of the counterweight tank which accounts for 14% of the total weight. The maximum storage buoyancy, together with the about 6% buoyancy obtained by discharging the water body of the ballast tank 28, forms the maximum buoyancy of the paired-hull catamaran 2, which accounts for about 42% of the total displacement of the paired-hull catamaran 2, and is the maximum buoyancy for floating upwards of the paired-hull catamaran 2 together with the submarine 3 clasped by it as a whole.

Double-breather-pipe ring: when the paired-hull catamaran 2 dives, the double-breather-pipe ring 12 continuously feeds fresh air into the catamaran, while continuously withdrawing the exhaust gas. The double-breather-pipe ring 12 is a concentric tube, which realizes coiling of breather pipes, in which an exhaust pipe is located at the outer ring and an intake pipe is located at the inner ring. One end of the concentric tube is wound on a breather-pipe reel 25 arranged on the buoyancy tank 1 to form a breather pipe coil for introducing fresh air and discharging exhaust gas, and the other end of the concentric tube is connected to the paired-hull catamaran 2 through a breather-pipe flange 13, so as to supply the fresh air to the paired-hull catamaran 2 and withdraw the exhaust gas therefrom. The breather pipe is wound off or up according to the diving depth of the paired-hull catamaran 2. When the paired-hull catamaran 2 dives to the deep-sea water area at a certain depth, the water pressure exerts an extremely large pressure intensity onto the breather pipe. In order to overcome the strength limitation of the breather pipe material, a forced gas intake and exhaust device, namely, a high-pressure gas intake and exhaust device, is arranged at the intake and exhaust port position (breather-pipe orifice 11) of the buoyancy tank 1. The high pressure forces the fresh air into the intake pipe, and the exhaust pipe automatically exhausts gas only when a certain pressure is reached. The high-pressure gas intake and exhaust device pre-applies a high pressure in the breather pipe to reduce the pressure difference between the interior and exterior of the breather pipe in the deep-sea water area, so as to reduce the pressure on the breather pipe applied by the strong water pressure outside the breather pipe.

Communication link: a linear communication circuit is disposed in the concentric breather pipes for communication and command links between the buoyancy tank 1 and the paired-hull catamaran 2; an underwater transmitting and receiving system for communication is installed at the flange connecting the breather pipe and the paired-hull catamaran 2, for reducing the underwater connection distance between the paired-hull catamaran 2 and the buoyancy tank 1 when the paired-hull catamaran 2 is disconnected from the breather pipe flange 13.

Coupling chain: for the coupling chain 20 between the buoyancy tank 1 and the paired-hull catamaran 2, one end of the coupling chain is coupled to the four corners at front and rear sides of the paired-hull catamaran 2, and the other end of the coupling chain is also disposed in the buoyancy tank 1 and wound on a chain drum 24, and the coupling chain is wound off or up according to the diving depth of the paired-hull catamaran 2; the four chains 20 are wound off at different lengths, which can control the balanced position of the paired-hull catamaran 2 and accurately salvage the submarine 3 inclined at the seabed; when the paired-hull catamaran 2 dives too deep, or when it encounters a strong ocean current, the coupled chain flange 23 can be disconnected, and an autonomous floating upwards mode is started for floating upwards, such that the balance degree of the paired-hull catamaran 2 is adjusted by adjusting the water filling amount of the front, rear, left and right ballast tanks 28, or the balance degree is adjusted by using the concave and rotatable flanking propellers provided on the paired-hull catamaran 2.

Inflatable and water-fillable bladder: when the paired-hull catamaran 2 clasps the submarine 3 in the deep sea, the lower steel hinge 18 is closed. At this time, there is a gap between the paired-hull catamaran 2 and the submarine 3, and in order to fix the submarine 3 to the paired-hull catamaran, water is filled into the bladder located inside the paired-hull catamaran, where water filling of the bladder is easy since the water pressures inside and outside the bladder are large, while the pressure difference between them is not large. However, air inflation requires a much larger high pressure, and thus is more difficult; when the paired-hull catamaran 2 floats upwards together with the submarine clasped by it, the water depth is decreasing and the pressure intensity is decreasing, but the volume of the water in the bladder does not change much, and the pressure difference between the interior and the exterior of the bladder does not change much; when the submarine support ship sails together with the submarine 3 clasped by it, the inflatable bladder 17 of the buoyancy tank 1 is inflated to fix the submarine 3 to the paired-hull catamaran; and when the submarine support ship sails as an empty ship, the bladder inside the paired-hull catamaran 2 and the bladder of the buoyancy tank are simultaneously inflated to discharge the water body in the hull of the submarine support ship, enabling sailing of the ship with a reduced self-weight.

The versatility of the submarine support ship: the submarine support ship is built according to the volume of a large-scale submarine 3. When salvage of a smaller submarine 3 is being conducted, and when the paired-hull catamaran 2 clasps the smaller submarine 3, considering the positional relationship between a submarine horizontal rudder 16 on a submarine bridge 6 and the docking hatch 10 of the buoyancy tank 1, after the submarine 3 is clasped, filling water into the inflatable and water-fillable bladder 17 of the paired-hull catamaran 2 to fix the smaller submarine 3 inside the paired-hull catamaran 2.

By setting multi-stage decompression chambers such as: an ultra-high pressure zone, a high pressure zone, a medium pressure zone, a low pressure zone, a normal pressure zone, etc. on parts having dynamic associations inside and outside the cabins of the paired-hull catamaran, such as the propeller, the rotatable flanking propeller 19, the breather pipe coupling flange, the robot, the double-segment-coupled hydraulic connecting rod 14, the rudder connecting rod, the water intake and exhaust valves, the steel-ball discarding valve, etc., it can overcome the huge pressure difference between the deep-sea super-high pressure outside cabins of the dived paired-hull catamaran 2 and the normal pressure of the cabins, conduct graded compression to cope with the requirements on the material strength by the huge pressure difference.

The driving window and observation window of the paired-hull catamaran: the windows are made of an acrylic plastic, and by means of the characteristics of the acrylic plastic that it has high strength and is plastically deformable, the windows and the window seats are sealed to each other by themselves.

The specific working modes of the submarine support ship of the present invention are as follows.

The empty-ship sailing mode of submarine support ship: the submarine support ship starts the empty-ship sailing mode to sail by turning on two main engines of the paired-hull catamaran 2, closing the lower steel hinge 18, inflating the inflatable bladders 17 inside the paired-hull catamaran 2 and of the buoyancy tank 1 to discharge the water body between the two hulls, and using a main propeller 4 equipped with dual propellers.

The normal deep-water submarine salvage mode of the submarine support ship: the submarine support ship is driven to the sea surface at a position corresponding to the underwater position of the submarine, in a direction same as that of the submarine 3, the paired-hull catamaran 2 and a fixing system of the buoyancy tank 1 is opened, the hatch 8 of the paired-hull catamaran 2 is closed, and the ballast tank 28 is filled with water, where when the weight of the paired-hull catamaran 2 is larger than its own displacement, the paired-hull catamaran 2 starts to dive; the power system of the buoyancy tank 1 is turned on before the paired-hull catamaran 2 leaves the buoyancy tank 1; along with the diving of the paired-hull catamaran 2, the buoyancy tank 1 supplies the double-breather-pipe ring 12 and the chain 20 which have the same length, and uses the concave and rotatable flanking propellers 19 of the buoyancy tank 1 itself to adjust its orientation; and when the paired-hull catamaran 2 reaches the position above the submarine 3, the lengths of the four coupling chains 20 are adjusted and the inclination of the paired-hull catamaran 2 is adjusted, such that the paired-hull catamaran is accurately aligned with the corresponding position of the submarine 3; the lower steel hinge 18 of the paired-hull catamaran 2 is opened to make the lower opening be larger than the width of the submarine 3, and then the paired-hull catamaran continually dives to the accurate position, afterwards the lower steel hinge 18 is closed, the inflatable bladder 17 on the inner wall of the paired-hull catamaran 2 is filled with water to fix the submarine 3 in the paired-hull catamaran 2; the buoyancy tank 1 winds up the coupling chains 20, such that the paired-hull catamaran 2 floats upwards together with the submarine 3, while the breather pipe is wound up; when the paired-hull catamaran 2 floats upwards together with the submarine 3 to a corresponding position coupled to the buoyancy tank 1, appropriate amount of water body is extruded out from the ballast tank 28, to realize the normal deep-water salvage procedure for the submarine 3 by the submarine support ship.

The deep-water self-rescue floating upwards mode of the paired-hull catamaran of the submarine support ship: when the dived paired-hull catamaran 2 encounters a special or emergency situation, as long as the steel sphere discarding valve 30 of the counterweight tank 29 is opened before the water permeates into the catamaran, since the specific weight of the steel spheres is much larger than that of the sea water and the steel spheres can slide, the steel spheres freely fall into the sea outside the cabin. At this time, the weight accounting for 50% of the total displacement is lost, and meanwhile the counterweight tank 29 is filled full of water, such that the weight of the counterweight tank 29 filled full of water which accounts for 14% of the total displacement is added, and when the control cabin, the corridor 27 and all cabins are all filled with water, the weight is increased by 24%, and thus the total weight accounts for 94% of the total displacement. That is, it is realized that even if all of the cabins are filled with water, the paired-hull catamaran 2 is surfaced by itself, achieving the deep-water self-rescue floating upwards procedure of the paired-hull catamaran 2.

The submarine salvage mode of the submarine support ship in which the breather pipe and the coupling chain are disconnected with the paired-hull catamaran: when both the double-breather-pipe ring 12 and the chain 20 cannot be used as the paired-hull catamaran 2 dives deeper into the deep sea water area to conduct rescue of the submarine 3 or as the paired-hull catamaran 2 encounters large ocean current, the main propeller 4 of the paired-hull catamaran 2 is turned off and a battery power supply mode is started; the breather pipe and the chain flange 23 are disconnected; the direction, position and inclination of the paired-hull catamaran 2 are adjusted by using the concave and rotatable flanking propellers 19; the diving or floating upwards speed of the paired-hull catamaran 2 is adjusted by the ballast tank 28. When the paired-hull catamaran 2 floats upwards together with the submarine 3 clasped by it, by discharging the entire water body of the ballast tank 28, the buoyancy accounting for about 6% of the total displacement of the paired-hull catamaran 2 is generated, which cannot reach the buoyancy required for floating upwards of paired-hull catamaran 2 together with the submarine 3 clasped by it as a whole, and thus it is necessary to start a storage buoyancy mode: the steel sphere discarding valve of the counterweight tank 29 is opened to discard the steel spheres, and accordingly the counterweight tank 29 is filled with sea water, and the maximum buoyancy generated at this time is a maximum storage buoyancy accounting for about 36% of the total displacement of the paired-hull catamaran 2, which is obtained by removing the steel spheres which account for 50% of the total weight and thus obtaining the water body weight of the counterweight tank 29 which accounts for 14% of the total weight. The maximum storage buoyancy, together with the 6% buoyancy obtained by discharging the water body of the ballast tank 28, forms the maximum buoyancy of the paired-hull catamaran 2, which accounts for about 42% of the total displacement of the paired-hull catamaran 2, and is the maximum buoyancy for floating upwards of the paired-hull catamaran 2 together with the submarine 3 clasped by it as a whole, thereby achieving the salvage procedure for the submarine 3 by the submarine support ship in which the breather pipe and the coupling chain 20 are disconnected with the paired-hull catamaran 2.

Concealed submarine rescue and safeguard mode of the submarine support ship: when the paired-hull catamaran 2 floats upwards together with the submarine 3 clasped by it as a whole, after the paired-hull catamaran is docked with and fixed to the buoyancy tank 1, according to the rescue plan, the concealed rescue hatch 8 of the buoyancy tank 1 accessing to the submarine 3 is opened, and the hatch cover of the submarine is opened, so as to provide salvation and medical care to the submarine personnel and to conduct maintenance, overhaul and replenishment of the submarine 3; and afterwards, the submarine 3 is released into the sea, or the submarine 3 is clasped back to the home port, thereby achieving the concealed rescue and safeguard procedure for the submarine 3 by the submarine support ship.

Concealed submarine security mode of the submarine support ship: a battery power supply mode of the paired-hull catamaran 2 is started, and the paired-hull catamaran is disconnected with a fixing device of the buoyancy-tank 1, disconnected with a breather-pipe flange 13 and a chain flange 23, dives after the hatch 8 is closed, and is docked with the submarine 3 by opening the lower steel hinge 18; the inflatable bladder 17 is filled with water to fix the submarine 3 to the paired-hull catamaran 2, and the paired-hull catamaran floats upwards together with the submarine 3 clasped by it as a whole; after the paired-hull catamaran 2 is docked with and fixed to the buoyancy tank 1, the concealed security hatch 8 of the buoyancy tank 1 accessing to the submarine 3 is opened and the hatch cover of the submarine is opened to conduct maintenance, overhaul, and replenishment of the submarine 3; and then the submarine 3 is released into the sea, or the submarine 3 is clasped back to the home port, thereby achieving the concealed security procedure for the submarine 3 by the submarine support ship.

The sailing mode in which the submarine support ship sails together with the submarine clasped by it: when the paired-hull catamaran 2 floats upwards together with the submarine 3 clasped by it as a whole, after the paired-hull catamaran 2 is docked with and fixed to the buoyancy tank 1, the concealed rescue hatch 8 of the buoyancy tank 1 accessing to the submarine 3 is opened, and the hatch cover of the submarine 3 is opened, so as to provides salvation and medical care to the submarine personnel and to conduct maintenance, overhaul and replenishment of the submarine 3; and afterwards, the submarine support ship can sail to a new mission area or the home port together with the submarine 3 clasped by it, thereby achieving the task that the submarine support ship sails together with the submarine 3 clasped by it.

The non-concealed submarine replenishment and security mode of the submarine support ship: when submarine support ship arrivals at port for replenishment, the replenishment is conducted by means of the materials and manpower entry and egress hatch 15 located at one side; and when non-concealed security is conducted for the submarine 3, the submarine support ship is docked at one side of the submarine, and the replenishment of the submarine 3 is conducted by means of the materials and manpower entry and egress hatch 15 located at one side of the submarine support ship, thereby completing the replenishment of the submarine support ship or the task of conducting non-concealed replenishment and security mode for the submarine 3.

One skilled in the art would be able to determine the characteristics needed for the various elements of the present invention.

PARTS LIST

1 buoyancy tank
2 paired-hull catamaran
3 submarine
4 main propeller
5 upper steel hinge
6 submarine bridge
7 control cabin
8 hatch
9 parking apron
10 docking hatch
11 breather-pipe orifice
12 double-breather-pipe ring
13 breather-pipe flange
14 hydraulic connecting rod
15 hatch door
16 horizontal rudder
17 inflatable bladder
18 lower steel hinge
19 flanking propeller
20 chain
21 engine room
22 upper steel-hinge guard arm
23 chain flange
24 chain drum
25 breather-pipe reel
26 buoyancy adjustment tank
27 corridor
28 ballast tank
29 counterweight tank
30 discarding valve Several examples are used for illustration of the principles and implementation methods of the present invention. The description of the aforementioned embodiments is used to help illustrate the method and its core principles of the present invention. In addition, those skilled in the art can make various modifications in terms of specific embodiments and scope of application in accordance with the teachings of the present invention. In conclusion, the content of this specification shall not be construed as a limitation to the invention.

What is claimed is:

1. A submarine support ship, comprising a buoyancy tank and a paired-hull catamaran which are docked with each other from top to bottom, wherein the paired-hull catamaran comprises two side hulls, and each thereof has upper and lower portions coupled by several pairs of steel hinges which are arranged symmetrically and spaced apart from each other, wherein the lower steel hinge can separate the connection, each of the two side hulls is provided with a control cabin, a power system and an activity space, wherein the power system comprises a propeller; the two side hulls of the paired-hull catamaran are each semi-arc-shaped, and the paired-hull catamaran has a section presented as water-drop-shaped after the two side hulls are coupled together by the upper and lower steel hinges, the paired-hull catamaran has a curved inner wall wherein the curved inner wall matches a contour of a submarine, and the curved inner wall is used for receiving the submarine; the curved inner wall of the paired-hull catamaran is provided with an inflatable bladder thereon; each steel hinge is provided with steel-hinge guard arms on both sides thereof, and the steel-hinge guard arms are separated at a distance, wherein the distance between respective steel-hinge guard arms meets a space setting of a submarine bridge;

the buoyancy tank is saddle-shaped, and two sides of the buoyancy tank are engaged with a curved top portion of the paired-hull catamaran, the buoyancy tank is provided with a control cabin, an autonomous auxiliary power device and a replenishment cabin therein, and the autonomous auxiliary power device comprises a propeller arranged on the buoyancy tank; and the buoyancy tank is provided with hatch doors in front of and behind both sides thereof, the buoyancy tank is provided with a concealed hatch to be docked with the submarine therein, the buoyancy tank has four corners wherein the buoyancy tank is engaged with the paired-hull catamaran by chains which are coupled with the paired-hull catamaran, and the buoyancy tank is also provided thereon with a double-breather-pipe ring connected to the two side hulls.

2. The submarine support ship of claim 1, wherein the paired-hull catamaran has a broadside and a stern, wherein the paired-hull catamaran is also provided therein with a storage battery, and the propeller comprises concave and rotatable flanking propellers which are disposed at the broadside and a main propeller equipped with propeller blades which is disposed at the stern.

3. The submarine support ship of claim 1, wherein the lower portion of each of the two side hulls of the paired-hull catamaran is provided with a counterweight tank, steel spheres are placed in the counterweight tank for counterweight, and a steel sphere discarding valve is disposed at a bottom end of the counterweight tank.

4. The submarine support ship of claim 1, wherein the upper portion of each of the two side hulls of the paired-hull catamaran is provided with a buoyancy adjustment tank, many multigrade hollow steel balls with different sizes are placed in the buoyancy adjustment tank, and the buoyancy adjustment tank is filled full of the multigrade hollow steel balls.

5. The submarine support ship of claim 1, wherein a middle portion of the paired-hull catamaran is provided with a ballast tank, and a water filling amount of the ballast tank is adjustable.

6. The submarine support ship of claim 1, wherein the double-breather-pipe ring comprises two concentric breather pipes, an outer ring and an inner ring, and has two ends, wherein an exhaust pipe is located at the outer ring and an intake pipe is located at the inner ring; one end of the double-breather-pipe ring is wound on a breather-pipe reel arranged on the buoyancy tank, and the other end of the double-breather-pipe ring is connected to the paired-hull catamaran through a breather-pipe flange; and the double-breather-pipe ring is wound off or up according to diving depth of the paired-hull catamaran.

7. The submarine support ship of claim 6, wherein a high-pressure gas intake and exhaust device is arranged at an intake and exhaust port position of the double-breather-pipe ring on the buoyancy tank; and a linear communication circuit is disposed in the double-breather-pipe ring, and an underwater transmitting and receiving system for communication is installed at the flange connecting the double-breather-pipe ring and the paired-hull catamaran.

8. The submarine support ship of claim 1, wherein one end of the coupling chain between the buoyancy tank and the paired-hull catamaran is coupled to four corners of the paired-hull catamaran at front and rear sides of the paired-hull catamaran, and another end thereof is wound on a chain drum inside the buoyancy tank; and the chain is wound off or up according to diving depth of the paired-hull catamaran.

9. The submarine support ship of claim 1, wherein the inflatable bladder can be filled with both water and gas.

10. A submarine and submarine support ship apparatus, the submarine support ship apparatus comprising a buoyancy tank and a paired-hull catamaran which are docked with each other from top to bottom, wherein the paired-hull catamaran comprises two side hulls, and each thereof has upper and lower portions coupled by several pairs of steel hinges which are arranged symmetrically and spaced apart from each other, wherein the lower steel hinge can separate the connection, each of the two side hulls is provided with a control cabin, a power system and an activity space, wherein the power system comprises a propeller; the two side hulls of the paired-hull catamaran are each semi-arc-shaped, and the paired-hull catamaran has a section presented as water-drop-shaped after the two side hulls are coupled together by the upper and lower steel hinges, the paired-hull catamaran has a curved inner wall wherein the curved inner wall matches a contour of the submarine, and the curved inner wall is used for receiving the submarine; the curved inner wall of the paired-hull catamaran is provided with an inflatable bladder thereon; each steel hinge is provided with steel-hinge guard arms on both sides thereof, and the steel-hinge guard arms are separated at a distance, wherein the distance between respective steel-hinge guard arms meets a space setting of a submarine bridge;

the buoyancy tank is saddle-shaped, and two sides of the buoyancy tank are engaged with a curved top portion of the paired-hull catamaran, the buoyancy tank is provided with a control cabin, an autonomous auxiliary power device and a replenishment cabin therein, and the autonomous auxiliary power device comprises a propeller arranged on the buoyancy tank; and the buoyancy tank is provided with hatch doors in front of and behind both sides thereof, the buoyancy tank is provided with a concealed hatch to be docked with the submarine therein, the buoyancy tank has four corners wherein the buoyancy tank is engaged with the paired-hull catamaran by chains which are coupled with the paired-hull catamaran, and the buoyancy tank is also provided thereon with a double-breather-pipe ring connected to the two side hulls.

11. The submarine and submarine support ship apparatus of claim 10, wherein the paired-hull catamaran has a broadside and a stern, wherein the paired-hull catamaran is also provided therein with a storage battery, and the propeller comprises concave and rotatable flanking propellers which are disposed at the broadside and a main propeller equipped with propeller blades which is disposed at the stern.

12. The submarine and submarine support ship apparatus of claim 10, wherein the lower portion of each of the two side hulls of the paired-hull catamaran is provided with a counterweight tank, steel spheres are placed in the counterweight tank for counterweight, and a steel sphere discarding valve is disposed at a bottom end of the counterweight tank.

13. The submarine and submarine support ship apparatus of claim 10, wherein the upper portion of each of the two side hulls of the paired-hull catamaran is provided with a buoyancy adjustment tank, many multigrade hollow steel balls with different sizes are placed in the buoyancy adjustment tank, and the buoyancy adjustment tank is filled full of the multigrade hollow steel balls.

14. The submarine and submarine support ship apparatus of claim 10, wherein a middle portion of the paired-hull catamaran is provided with a ballast tank, and a water filling amount of the ballast tank is adjustable.

15. The submarine and submarine support ship apparatus of claim 10, wherein the double-breather-pipe ring comprises two concentric breather pipes, an outer ring and an inner ring, and has two ends, wherein an exhaust pipe is located at the outer ring and an intake pipe is located at the inner ring; one end of the double-breather-pipe ring is wound on a breather-pipe reel arranged on the buoyancy tank, and the other end of the double-breather-pipe ring is connected to the paired-hull catamaran through a breather-pipe flange; and the double-breather-pipe ring is wound off or up according to diving depth of the paired-hull catamaran.

16. The submarine and submarine support ship apparatus of claim 15, wherein a high-pressure gas intake and exhaust device is arranged at an intake and exhaust port position of the double-breather-pipe ring on the buoyancy tank; and a linear communication circuit is disposed in the double-breather-pipe ring, and an underwater transmitting and receiving system for communication is installed at the flange connecting the double-breather-pipe ring and the paired-hull catamaran.

17. The submarine and submarine support ship apparatus of claim 10, wherein one end of the coupling chain between the buoyancy tank and the paired-hull catamaran is coupled to four corners of the paired-hull catamaran at front and rear sides of the paired-hull catamaran, and another end thereof is wound on a chain drum inside the buoyancy tank; and the chain is wound off or up according to diving depth of the paired-hull catamaran.

18. The submarine and submarine support ship apparatus of claim 10, wherein the inflatable bladder can be filled with both water and gas.

* * * * *